US005092544A

United States Patent [19]

Petit et al.

[11] Patent Number: 5,092,544

[45] Date of Patent: Mar. 3, 1992

[54] HIGHWAY CROSSING CONTROL SYSTEM FOR RAILROADS UTILIZING A COMMUNICATIONS LINK BETWEEN THE TRAIN LOCOMOTIVE AND THE CROSSING PROTECTION EQUIPMENT

[75] Inventors: William A. Petit, Spencerport; John W. Parker, Rochester; Zalmai Shahbaz, Penfield, all of N.Y.

[73] Assignee: General Railway Signal Corp., Rochester, N.Y.

[21] Appl. No.: 456,122

[22] Filed: Dec. 22, 1989

[51] Int. Cl.[5] ..... B61L 29/32

[52] U.S. Cl. ..... 246/126; 246/122 R; 246/4; 246/187 A

[58] Field of Search ..... 246/3-6, 246/115, 122 R, 125-127, 187 A, 187 B, 189

[56] References Cited

U.S. PATENT DOCUMENTS

| | | | |
|---|---|---|---|
| 1,978,286 | 10/1934 | Sommer . | |
| 2,028,497 | 1/1936 | Clausing et al. . | |
| 2,131,042 | 9/1938 | Halstead . | |
| 2,368,826 | 2/1945 | Hailes et al. . | |
| 2,399,738 | 5/1946 | Howe . | |
| 2,433,281 | 12/1947 | Lord . | |
| 3,246,143 | 4/1966 | Steele et al. . | |
| 3,267,281 | 8/1966 | Buck | 246/125 |
| 3,297,868 | 1/1967 | Shaw . | |
| 3,558,874 | 1/1971 | Freehafer | 246/126 |
| 3,603,786 | 9/1971 | Peel . | |
| 3,610,920 | 10/1971 | Frielinghaus . | |
| 3,781,541 | 12/1973 | Darrow et al. . | |
| 3,781,542 | 12/1973 | Brockman . | |
| 3,944,173 | 3/1976 | Moe et al. . | |
| 4,087,066 | 5/1978 | Bahker et al. . | |
| 4,120,471 | 10/1978 | Auer, Jr. . | |
| 4,172,576 | 10/1979 | Svet, Jr. et al. . | |
| 4,365,777 | 12/1982 | Geiger . | |
| 4,550,444 | 10/1985 | Uebel . | |
| 4,582,280 | 4/1986 | Nichols et al. . | |
| 4,703,303 | 10/1987 | Snee . | |
| 4,711,418 | 12/1988 | Aver, Jr. et al. . | |
| 4,735,383 | 4/1988 | Corrie . | |
| 4,860,977 | 8/1989 | Norton | 246/3 |
| 4,942,395 | 7/1990 | Ferrari et al. | 246/127 X |
| 4,974,259 | 11/1990 | Takahashi et al. | 246/122 R X |

FOREIGN PATENT DOCUMENTS

| | | | |
|---|---|---|---|
| 1160881 | 1/1964 | Fed. Rep. of Germany | 246/126 |

*Primary Examiner*—Robert J. Spar
*Assistant Examiner*—Scott L. Lowe
*Attorney, Agent, or Firm*—Martin Lukacher

[57] ABSTRACT

Highwasy crossing protection equipment which operates warning lights or crossing gates is controlled from the train locomotive which enters into an interchange of messages via a radio link with the controller at the crossing. Communications between the train and the crossing controller is initiated when the locomotive passes a trackside beacon transponder located beyond a safe braking distance from the crossing. The crossing controller transmits a message addressed to the train acknowledging the receipt of the train signal. The interchange of messages can be repeated a plurality of times; each time the minimum time being updated so that traffic flow across the crossing is handled efficiently with minimum interference. All communications are handled through vital communications logic which activates the protection equipment to its safe condition or sets alarms or brakes in the train in the event of errors or failures in the messages being handled in the crossing controller or in the train equipment, respectively. Wayside signals may also be used to warn the train driver to stop the train unless the communication link has been established. The crossing protection equipment is responsive to successive occupancy and unoccupancy of the crossing.

29 Claims, 7 Drawing Sheets

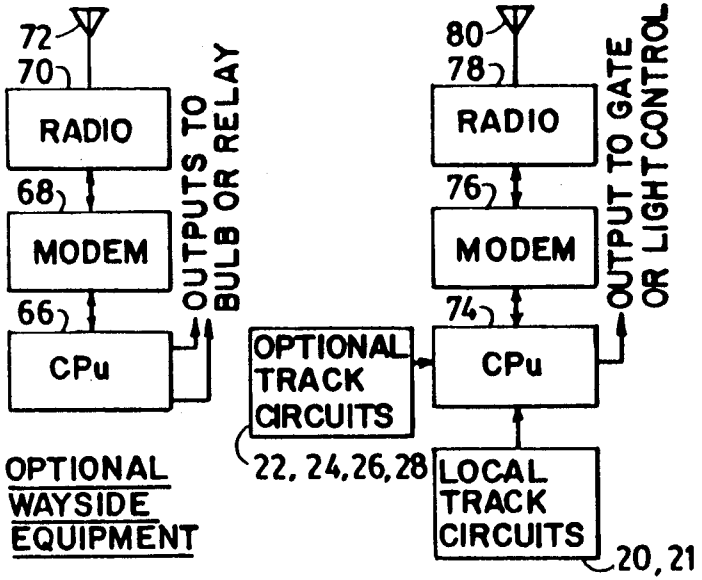
HIGHWAY CROSSING EQUIPMENT
FIG. 4
OPTIONAL WAYSIDE EQUIPMENT
FIG. 3
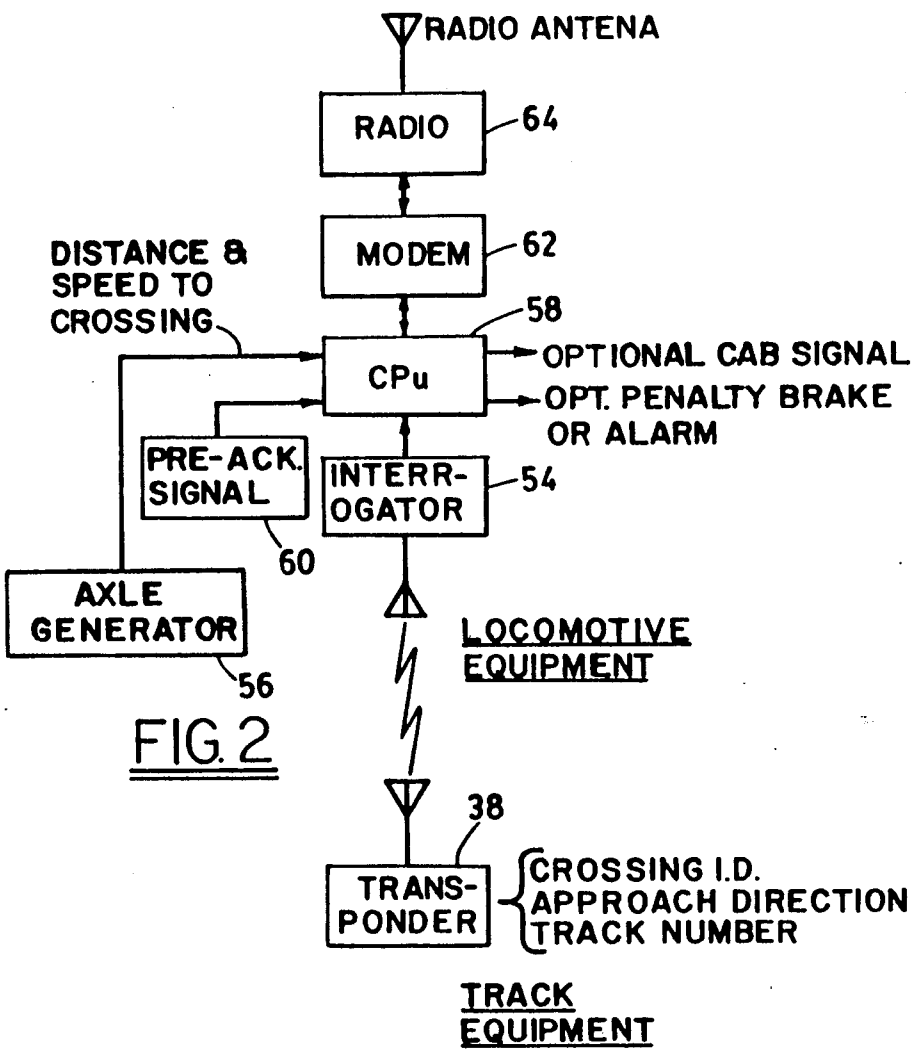
FIG. 2

HIGHWAY CROSSING CONTROL SYSTEM FOR RAILROADS UTILIZING A COMMUNICATIONS LINK BETWEEN THE TRAIN LOCOMOTIVE AND THE CROSSING PROTECTION EQUIPMENT

The present invention relates to highway crossing control systems (methods and apparatus) for railroad crossings and particularly to a system for controlling crossing protection equipment (warning lights or gates) and trains approaching a crossing so as to provide for vital (fail-safe) operation while minimizing interference with the flow of highway traffic across the crossing.

The present invention is especially suitable for use in a "Spacerail" (TM) railway signalling and traffic control system wherein information is conveyed between trains and the central office by radio signals. The Spacerail system is offered by the General Railway Signal Company, a unit of General Signal Corporation, Rochester, N.Y. 14602-0600 U.S.A. and is described in U.S. Pat. No. 4,711,418 issued Dec. 8, 1987 to J. H. Auer and W. A. Petit. The present highway crossing control system may utilize the control units and processors of the Spacerail system or may be used as a stand-alone system.

Highway crossing control systems for railroad tracks conventionally utilize track circuits which extend sufficiently far along the approaches to the crossing that the fastest allowable train will be detected and cause the crossing protection equipment to assume its safe condition, before the fastest allowable train reaches the crossing, and preferably allowing sufficient warning time for the highway traffic to be halted. While circuits can be designed to detect the direction and speed of trains, such circuits are complex requiring significant installation and maintenance costs. Some crossings must handle multiple tracks requiring these track circuits and motion detection circuits on each of the multiple tracks and for each approach direction, further increasing the costs.

Radio-based control systems have been suggested and are discussed in the above-referenced patent, for track occupancy and speed control and for the control of wayside equipment such as track switches. It is the feature of this invention to provide a radio-based system for highway crossing control whereby vital operation can be maintained with minimum interference with the flow of traffic thereby enabling traffic flow to be handled efficiently. Efficient traffic control leads to greater fuel economy and less automotive pollution of the environment by emissions from vehicles standing at a crossing with their motors running. Another feature of the invention is to continually respond to the motion of the train, detecting whether it is moving or stopped and at what speed, so as to control the trains approaching a crossing, and the crossing itself, at lower cost than conventional systems which are capable of detecting train motion.

Briefly described, a system (method and apparatus) embodying the invention controls the operation of crossing protection equipment guarding a highway crossing for railroad tracks along which railroad trains travel. The system is vital (fail-safe) in that it prevents the trains from moving into the crossing unless the protection equipment is in its safe condition (blocking the flow of traffic across the crossing) and actuates the crossing equipment to its safe condition in the event of any failure of communications or in the crossing controller itself. The safe condition is a second state of the crossing protection equipment in which the highway traffic across the tracks is disallowed. The equipment has a first state in which highway traffic across the tracks is allowed. The system operates by establishing a communications link between a train approaching the crossing and the crossing equipment, and operates by interchanging messages over the communications link from the approaching train to the crossing equipment and from the crossing equipment to the approaching train. The messages from the approaching train contain information as to the speed of the approaching train and its distance from the crossing. The messages from the crossing equipment to the train contain information as to the time when transmission of a next successive message from the approaching train is required. The crossing equipment computes a minimum time for the equipment to be disposed in its first state, when the link is first established by receipt of a first of the messages from the approaching train. The system then updates the minimum time upon each interchange of messages from the equipment to the train and from the train to the equipment. The crossing equipment is conditioned into its second state upon expiration of the latest updated minimum time. Then the flow of traffic across the crossing is interfered with for the minimum period of time.

Local track circuits overlaid at the crossing, or other occupancy detection means, may be used to provide signals for returning the protection equipment back to its first state when the approaching train has cleared the crossing.

The first message from the train is initiated when the train locomotive passes a beacon, which is preferably a beacon transponder interrogated by locomotive-carried equipment, which beacon transponder is located well beyond the safe braking distance for trains travelling at fastest speed allowed toward the crossing. Other wayside equipment such as approach track circuits or wayside signals which are normally set to a restrictive state (warning the trains to slow or stop), and switches adapted to be actuated by the train driver before reaching the beacon, may optionally be used to further assure the vital operation of the system.

The foregoing and other objects, features and advantages of the invention as well as presently preferred embodiments and the best modes known for practicing the invention will become more apparent from a reading of the following description in connection with the accompanying drawings in which:

FIG. 2 is a block diagram schematically illustrating the locomotive-borne equipment of a system embodying the invention; and also the transponder which communicates with the locomotive-borne equipment;

FIG. 3 is a block diagram of equipment associated with optional wayside signals which may be used in the system provided by the invention;

FIG. 4 is a block diagram of the highway crossing protection equipment of the system;

Figure 5A:
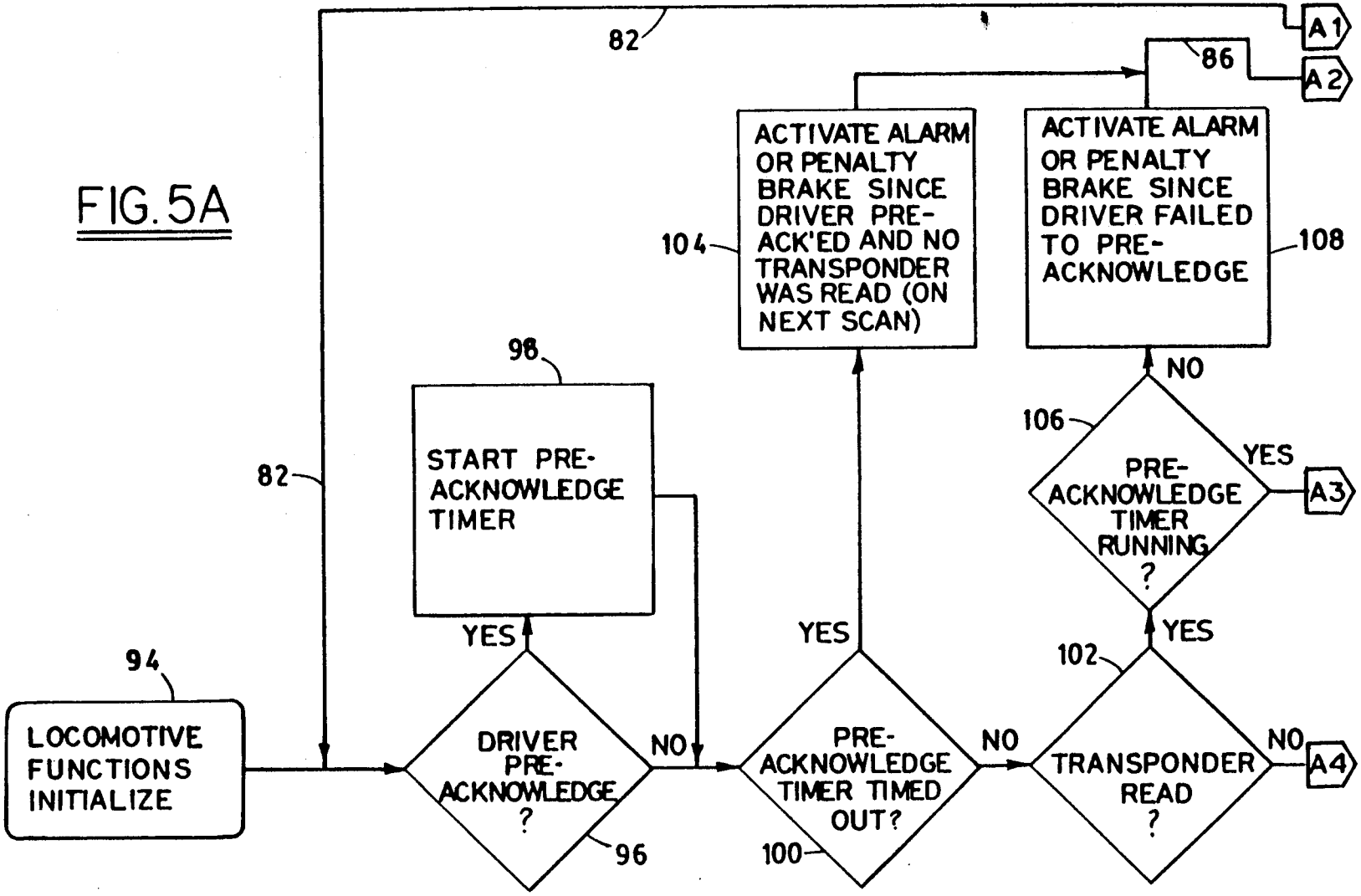
Figure 5B:
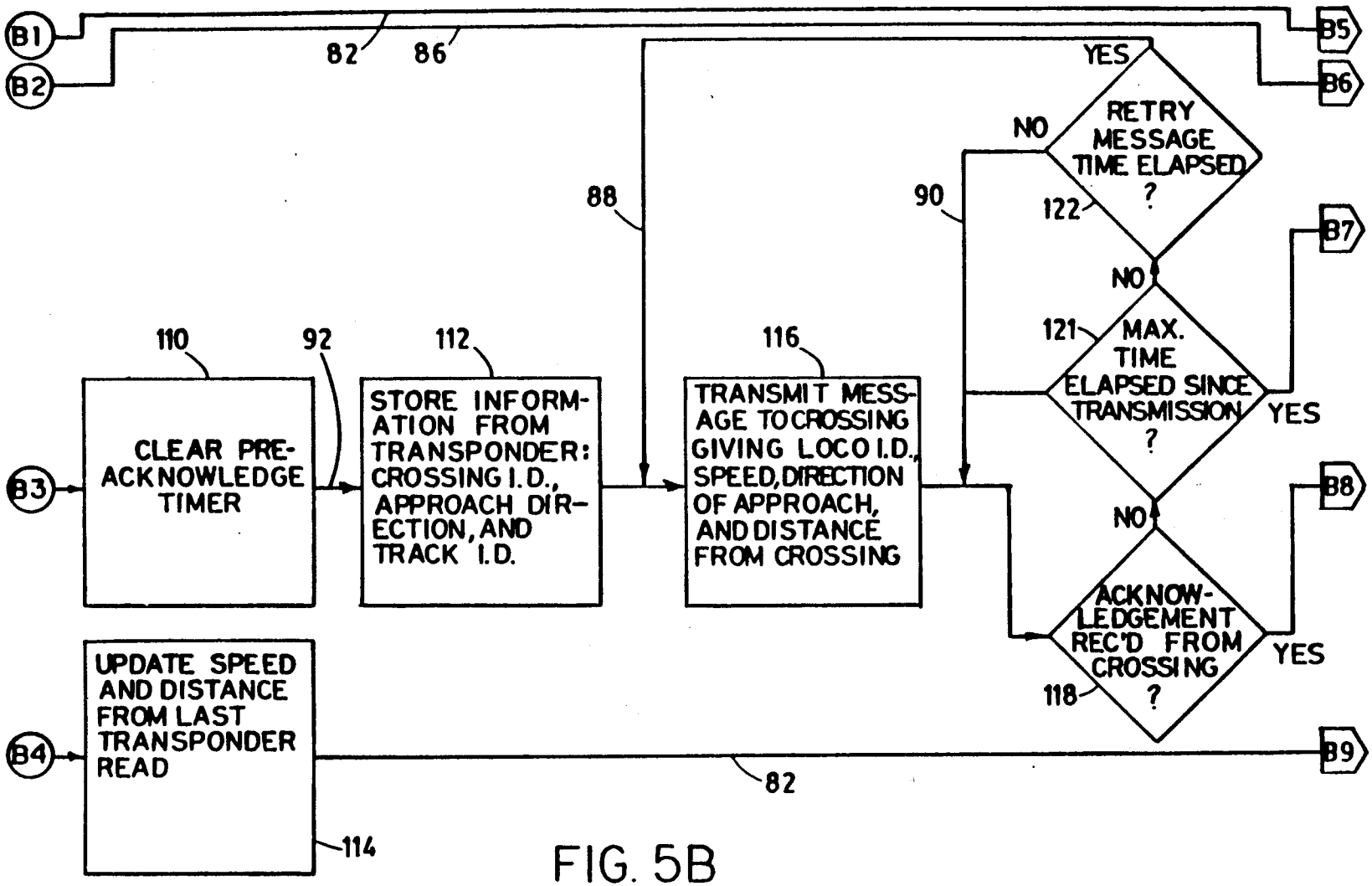
Figure 5C:
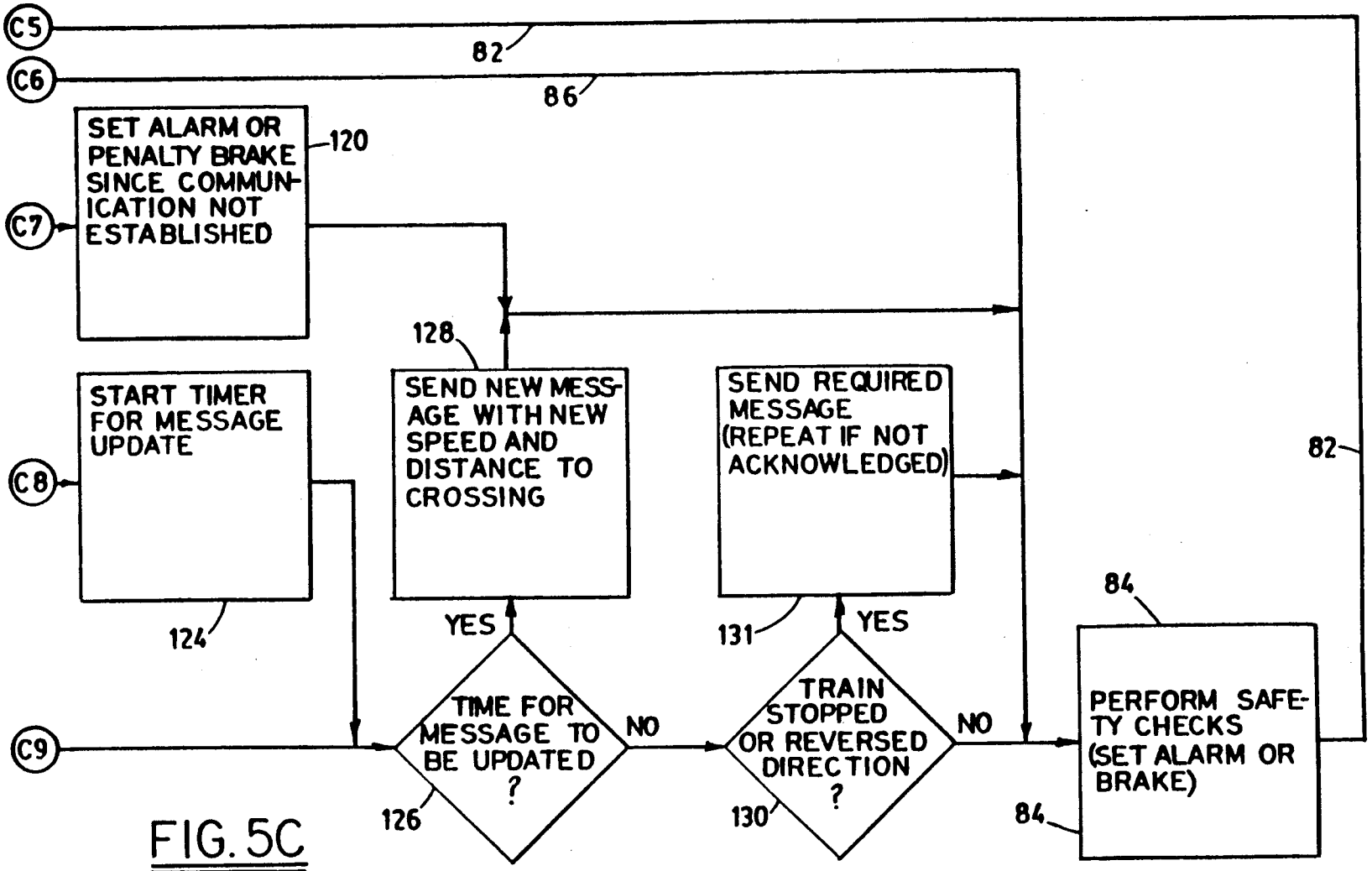
Figure 6A:
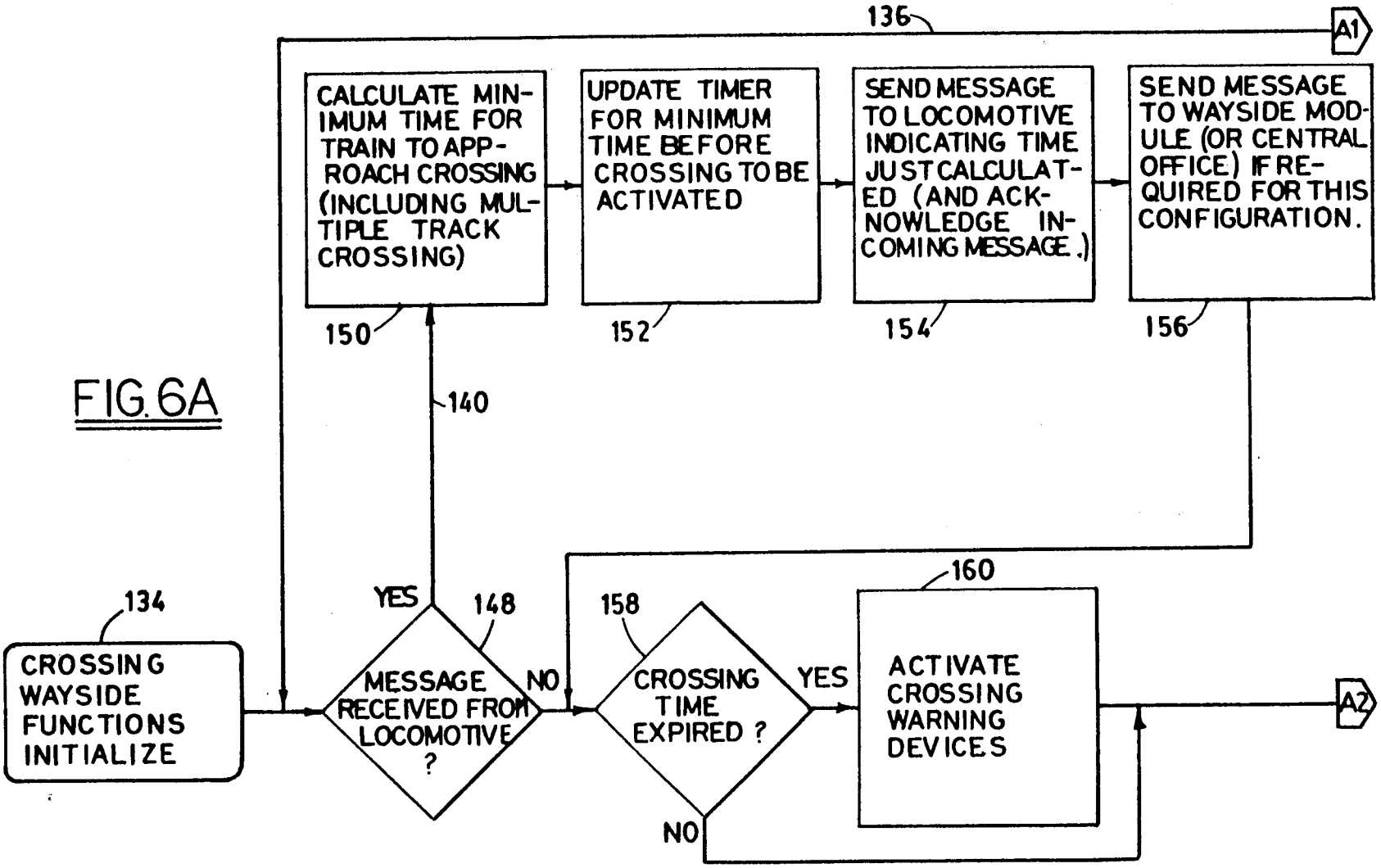
Figure 6B:
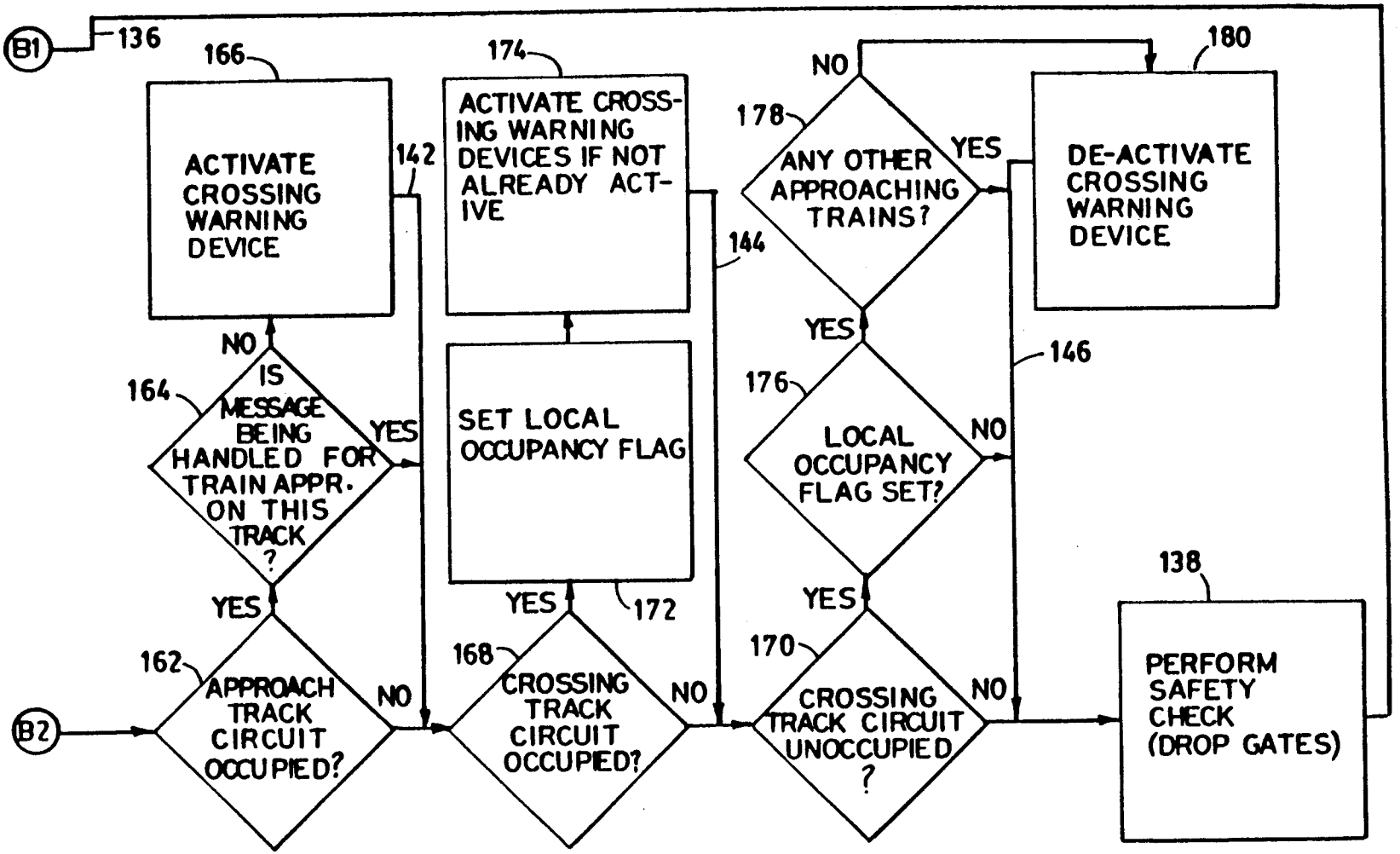

FIGS. 5A–C is a flow diagram of the program of the computer (CPU) of the locomotive-borne equipment; and FIGS. 6A–B is a flow diagram of the program in the controller (CPU) of the highway crossing equipment.

Figure 1:
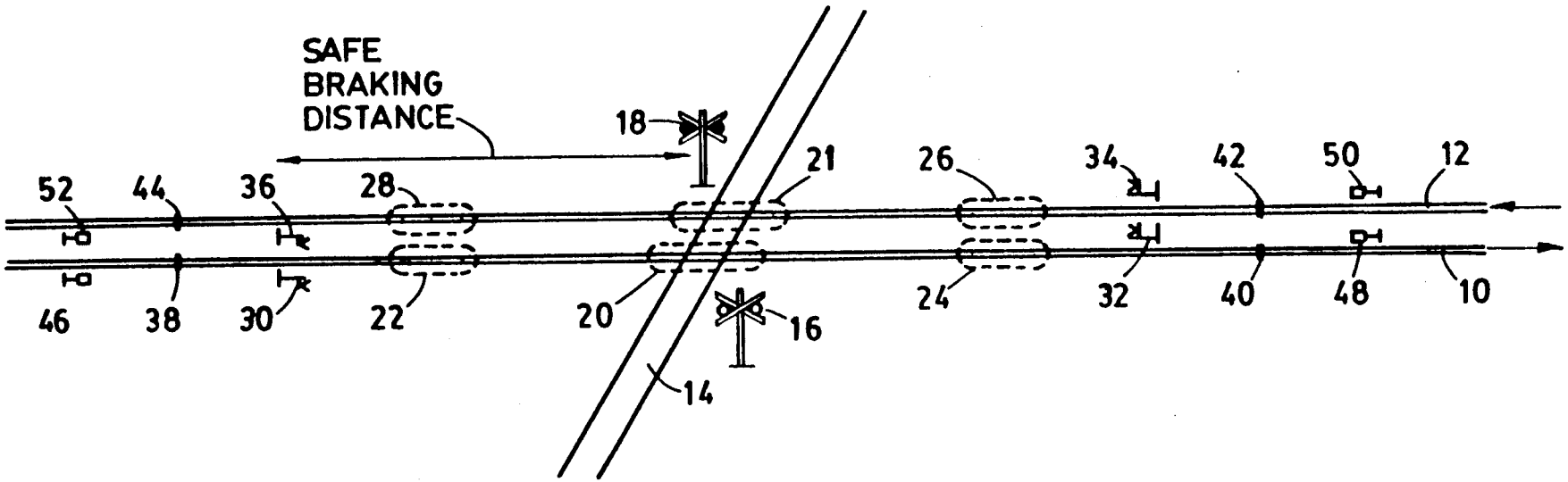
FIG. 1 is a schematic diagram showing the layout of a multiple (e.g., two track) section of a railway territory with a highway crossing, which crossing is adapted to be operated by a system provided in accordance with the invention.

Referring to FIG. 1 there is shown two sets of tracks 10 and 12. Trains are authorized to travel from east to west along one of these sets of tracks 10 and from west to east along the other set of tracks 12. However, it may be possible for trains to travel in either direction along the track. The tracks are in a section of the railway territory which is crossed by a highway crossing 14 where vehicles, automobiles, trucks, etc. pass over the tracks 10 and 12. The tracks are guarded by protection equipment which may be highway crossing warning lights or gates and are illustrated as warning lights 16 and 18. Independent track circuits 20 and 21 (typically audio frequency overlay track circuits) are overlaid on the tracks in the immediate vicinity of the crossing. These track circuits are used to indicate occupancy, and particularly the successive occupancy and unoccupancy by trains of the track sections 10 and 12 so as to provide signals to the crossing equipment indicative of trains having moved clear of the crossing.

Spaced from the crossing, at a distance which would allow the gates to drop (or lights to flash) for the minimum required time for the fastest train allowed along that section of rail, are optional approach track circuits 22, 24, 26, 28. These circuits can be provided to allow operation of trains not equipped with the locomotive controls across the highway crossing. These optional approach track circuits are connected to the highway crossing equipment so that trains entering these track circuits are detected and signals are provided to the crossing equipment to condition it to its safe state immediately (warning lights flashing or gates dropped).

As another alternative to the optional approach track circuits, still further from the crossing and sufficiently far for the trains to stop before reaching the crossing, are optional wayside signals 30, 32, 34 and 36. These signals are normally in their restrictive state and will warn oncoming trains to slow or stop if communication with the crossing has not been established. They are changed to a less restrictive state, for example, clear or green, when the radio system is communicating signals between the trains and the crossing equipment. The distance from the optional approach track circuits to the crossing may for example be approximately one half mile assuming the maximum train speed of 60 miles per hour and a requirement that the protection equipment be in operation (lights flashing or gates down) for 30 seconds before a train reaches the crossing. Then the optional wayside signals may, for example, be one mile from the crossing. These distances will, of course, depend upon conditions around the crossing such as grades and the maximum speeds of the trains and minimum braking rate of the train.

Still further from the crossing and at least a sufficient distance to set up the communications link between the train equipment and the crossing equipment are beacons, preferably beacon transponders 38, 40, 42 and 44. These transponders may be the transponders of Identifier (TM) automatic vehicle identification equipment which is commercially available from the General Railway Signal Company. This equipment is described in the above-referenced Auer and Petit patent.

Still further away from the crossing are optional pre-acknowledge signs 46, 48, 50 and 52. These signs are used to alert the driver of trains approaching the crossing (railroad engineers) to activate a pre-acknowledge push button switch. Such manual actuation has the advantage of making sure that the driver is alerted to the upcoming crossing and also provides facilities for checking the operation of the upcoming transponder 38–44.

Referring to FIG. 2, there is shown one of the transponders 38. It is shown in radio communication with an interrogator 54 which activates and powers the transponder and receives messages therefrom. These messages are digitally coded bits containing fields. Fields of data which are provided include representations of the identity of the upcoming crossing (crossing I.D.); the direction of approach of the train which will be from the west or east, the track number, for example, track 10 will be track No. 1 and track 12, No. 2 and the distance to the crossing.

An axle generator, 56, is used to determine train speed, distance traveled and indicate direction changes. The axle generator may provide a pulse train; the number of pulses being indicative of distance traveled, since they are generated a pre-determined number of times for each rotation of the wheel; the length along the periphery of which is known.

The number of pulses is used in the axle generator to provide a speed signal to the controller. This controller is a microcomputer central processing unit or CPU 58. When the highway crossing control system is, within the Spacerail radio signalling system the CPU 58 may be provided by the computer control unit of the locomotive-borne Spacerail equipment. The CPU 58 also receives an input to an input port thereof which may be separate from the input port to which the axle generator 58 is connected from the pre-acknowledge switch 60, if the optional pre-acknowledge function is included in the system. The CPU 58 also participates in establishing a communications link with the crossing equipment; and via that link by transmitting signals via a modem (modulator demodulator) 62 and a radio 64. This radio is connected to an antenna which broadcasts messages so that they can be received by the highway crossing equipment.

If the system is within a Spacerail system, the radio signals are also broadcast to the central office equipment. The radio 64 is normally in a receive mode and is conditioned to transmit messages when activated by control signals from the CPU 58. The CPU may be connected to a display in the locomotive cab which indicates the aspect (allowed speed) and movement over the track section. Connection to the display is used when the CPU is part of the Spacerail system. The connection to the cab signal display is optional in a stand-alone system. The CPU has an output port which is connected to drive the controller of a brake or to actuate the train's brakes or an alarm. This brake is referred to as a penalty brake, since braking is the result of either a failure in the system, or a failure to establish a communication link or the failure to pre-acknowledge or communicate with the transponders after a pre-acknowledge, if the optional pre-acknowledgment is included in the system.

The CPU program causes it to establish the communications link by transmitting a message, when the beacon transponder 38 communicates with the locomotive equipment via the interrogator 54. The CPU message is the digital message containing a number of fields including a check bit or check value field to insure vital communications. Such vital communications checks are performed within the CPU. The data fields are the crossing I.D., approach direction, track number, the speed of the train and the distance to the crossing. This distance may be computed by subtracting a known distance between the transponder and the crossing from the distance traveled by the train since passing the transponder. This distance signal may be generated in the axle generator which may contain its own microprocessor which communicates with the CPU or in the CPU itself. The message is, therefore, a vital message. The vital communications techniques are discussed in the above-referenced Auer and Petit patent and further information with respect thereto may be obtained from the patents referenced in the Auer and Petit patent and in U.S. Pat. No. 4,831,521 issued to Rutherford.

The messages which are directed to the crossing equipment will be addressed to the crossing equipment because of the crossing I.D. field. In the event that the message is to be transmitted also to the central office, the address of the central office will be included in a field in the message.

Referring to FIG. 3 there is shown equipment utilized at each optional wayside signal 30, 32, 34 and 36. The wayside signals communicate with the crossing by way of radio with packets of vital messages. The wayside equipment utilizes a CPU 66, a modem 68 and a radio 70 connected to an antenna 72. The vitality of the message is checked by vital processes in the CPU 66 upon receipt over the radio 70 and translated into digital form by the modem 68. When the message is addressed to the CPU, it provides outputs to the bulbs of the warning lights or to relays which may operate the signal so as to change the signal from its normal restrictive state (e.g., red) to a less restrictive state, (e.g., either yellow or green) so as to allow the trains to proceed towards the crossing.

Referring to FIG. 4 there is shown the highway crossing controller equipment. This equipment contains another CPU 74 which provides an output to the highway protection device which conditions it to its safe state with the lights flashing or gate down or to another state which enables the vehicular traffic to pass over the crossing. The CPU receives inputs from the optional track circuits 22-28 as well as from the local track circuits 20 and 21. The CPU 74 also communicates with the locomotive equipment or with the wayside signals by transmitting messages via a modem 76, a radio 78 and an antenna 80. These messages are addressed to the locomotive or the wayside signal and may, if the system is part of the Spacerail system, be addressed to the central office. These are vital messages containing check values which enable vital processing.

While a radio link is shown between the crossing equipment and the wayside signal equipment of FIG. 3, it will be appreciated that the wayside equipment may be connected by a wire line rather than over the radio, the selection of communication link depending upon the terrain and allowable costs for the installation.

The operation of the system and the program of the CPU, both as to its structure and function, will become more apparent from FIGS. 5 and 6. These programs include the optional pre-acknowledge, approach track circuit and wayside signal functions, which may be omitted if desired. Consider first the program in the CPU 58 of the locomotive equipment. There is a principal loop labeled 82 on the top, bottom and sides thereof. Messages are handled through vital processing indicated in one operation block 84 entitled "Perform Safety Checks" which are carried out by a vital processor or logic such as described in the above-referenced patents. It will be appreciated that such vital processing operations may be performed on the messages being handled in various parts of the program, if desired. If the result of the process is an error in the message which, of course, is indicative of a communications failure or a failure in a component of the system, the output to set the brakes or alarm is activated. The train may then be stopped or allowed to proceed at a restricted speed until the failure is corrected.

The program includes a loop 86 associated with the pre-acknowledge function and loops 88, 90 and 92 associated with the communications function. Another branch 93 is provided for communication when the train is stopped or reverses its direction to a direction away from the crossing.

The locomotive functions are provided by successive scans around the main loop 82. Decisions are made and messages are generated depending upon changes in inputs (new information from the transponder, messages received over the radio link and time outs).

The locomotive functions are initialized (resets are provided on start up as indicated by the initialize operation 94). The input from the pre-acknowledge scan results in a decision 96 to start a pre-acknowledge timer 98. This timer (a software timer) runs for a sufficient time to detect a transponder read after the locomotive passes a pre-acknowledgment sign (e.g., 46 FIG. 1). There are two unsafe conditions, namely that the driver operated the pre-acknowledge button inadvertently or at an improper time, or that communications between the transponder was not established. Therefore, a decision 100 is made to activate the alarm or the brake if the timer has timed out. However, this decision is delayed for a pre-determined number of scans around the main loop to allow time for the transponder to be read. If a transponder read 102 occurs, the time out of the pre-acknowledged timer will be disregarded and the brake or alarm operation 104 will not be carried out.

The safe condition is that reading of the transponder 102 occurs while the pre-acknowledge timer is still running 106. If the pre-acknowledge timer is not running, a failure in communications with the responder causes an operation 108 since either the driver failed to pre-acknowledge or the transponder did not read within the allowable time.

The first time a transponder is read, the operation 110 occurs to clear the pre-acknowledge timer. The information read from the transponder is stored in the memory of the CPU. The storage operation 112 thus occurs after a transponder read. This information is stored and also the location in memory of the CPU from which messages are derived is updated as indicated by operation 114. The message is transmitted over the radio as indicated by operation 116. Based upon the speed and distance information, a maximum elapsed time for the train to be stopped is computed by the crossing controller and sent by radio back to the locomotive. This message is also used as an acknowledgement of the message previously sent by the locomotive. If no acknowledgment is received over the radio link from the crossing equipment as indicated by decision block 118, it is taken that the communication link has not been established. Then after the elapse of this allowable time (for example, 15 seconds which is a nominal amount of time typical in most railroad territories), the brake or alarm operation 120 is carried out. Within the 15 seconds, the message is retransmitted after a time elapse as indicated by decision block 122. The maximum time elapsed decision is indicated by block 121. Accordingly there will be a plurality of attempts to establish the communication link.

Assuming that the link is established, the next operation 124 is to start a message update timer. The timing value for this update timer is something less than the time computed by the crossing controller and sent to the locomotive. This process allows new information to be sent from the locomotive to the crossing controller before the crossing gates are dropped. Current inormation on speed and distance to the crossing are determined from process block 114. When the message update time has elapsed (decision block 126), a new message will then be sent (operation 128). Since an acknowledgment has already been received from the crossing, communication has been established and the decision 121 will not be required. Accordingly, the brake operation 120 does not occur unless since the crossing controller will cause the gates to be dropped if there is a failure in communications.

In the event the approaching train has stopped or reversed its direction as indicated by the axle signal and read at the time for message update (decision block 130), a new message is sent and repeated if not acknowledged as in the case of the speed and direction messages. This new message will be used to prevent the highway protection device from stopping the flow of traffic unless the train starts toward the crossing again.

Referring to FIGS. 6A & B, the program in the CPU 76 at the highway crossing, i.e., the crossing functions, is also initialized on start up as shown by block 134. The program of the highway crossing equipment also has a main loop 136 which contains the vital message processing operations indicated by the perform safety checks block 138. These processes are shown at one point in the main loop but may be used within different parts of the main loop and in the other loops of the program. These other loops handle the updating of conditions (loop 140), the optional approach track circuits (loop 142) and the functions of the local crossing track circuits 20 and 22 (FIG. 1), the latter loops being loops 144 and 146.

When a message is received from the locomotive equipment, as indicated by decision block 148, the speed and distance information is used to calculate a minimum time for the approaching train to reach the crossing. This time assumes that the train is accelerating at a maximum rate if it is not already traveling at the maximum allowable speed. In the event of multiple track crossings, there will be multiple messages received over the radio links and the worst case minimum time will be used. This calculation is indicated by operations block 150. Next a timer (in software) is set. This operation establishes the minimum time before the crossing warning equipment is to be activated to its safe state. Then the CPU 74 transmits, via the modem 76 and radio 78, a message addressed to the locomotive indicating the minimum time which was calculated. This operation 154 provides the acknowledge message. A message is also sent to the wayside module causing the optional wayside signal to be cleared. If the system is integrated within a Spacerail system, the message may be addressed to the central office which then operates the wayside module or spacerail type in-cab signal aspect by transmitting a message thereto. This operation is indicated at 156. The loop 140 is successively scanned and the minimum time timer is updated as indicated by operation 152.

Going back to the main loop 136, when the minimum time (i.e. the time for the train to reach the crossing) has expired as indicated by decision 158 the highway protection equipment (the gates are activated to drop or other warning devices are activated 160. Accordingly, the safe condition of the warning devices will only occur when the train reaches the crossing. The time for the gates to be down is then minimized with the advantages of improved vehicular traffic flow over the crossing (14 FIG. 1).

If the approach track circuits 22 to 28 are used and occupancy is indicated upon a scan through the main loop 136 as shown at 162, the program checks to see if communications have been established and messages are being handled, 164. If communications have not been established, the gate protection warning devices are activated, 166.

In the event that the approach track circuits are not included or are not occupied the program proceeds to check the inputs from the local crossing track circuits 20 and 22 (FIG. 1). The crossing track circuits are either occupied or unoccupied as indicated by decision blocks 168 and 170. If the crossing is occupied, a local occupancy flag is set 172. When this local occupancy flag is set a by-pass is established to activate the crossing protection of warning devices 174.

If the crossing circuits are unoccupied and the local occupancy flag has been set, as in indicated by decision block 176, the program has determined that a train has cleared the crossing. Then, unless messages are being handled as to other approaching trains which require the crossing to be protected and the warning devices activated, 178 the warning devices are deactivated 180. If the warning devices are gates they are lifted and traffic allowed to pass over the crossing.

Instead of a wayside signal, as a further safety assurance, the proceed signal may be provided on the display as a aspect; authorizing or deauthorizing the train to proceed. A response from the highway crossing equipment (FIG. 4) is needed for authority to permit movement across the highway. If the highway crossing control system is incorporated within a Spacerail system, zone boundary transponders may be located at the safe braking distances from the crossing. The crossing equipment then communicates its messages with the central office informing the central office that it has control of the on-coming train. The office then transmits messages addressed to the train when it arrives at the zone boundary transducer preceding the crossing, and can allow the signal aspect for the zone past the zone boundary to be upgraded, allowing the train to proceed at normal speed. Periodic checking of the crossing equipment by the central office equipment may be carried out in the vital processor of the central office computer to assure that the system is vital and operation when operating via the central office.

From the foregoing description it will be apparent that there has been provided an improved highway crossing control system. An exemplary system has been described with various options for multiple, back-up safety functions. Variations and modifications of the herein described system as well as other functions within the scope of the invention will undoubtedly suggest themselves to those skilled in the art. Accordingly the foregoing description should be taken as illustrative and not in a limiting sense.

We claim:

1. The method for controlling the operation of crossing protection equipment guarding a highway crossing for railroad tracks along which trains travel, said equipment having first and second states in which highway traffic across said tracks is allowed and disallowed respectively, said method comprising the steps of establishing a communications link between a train approaching said crossing and the equipment, interchanging messages over said link from said approaching train to said equipment and from said equipment to said approaching train, respectively, as to the speed of said approaching train and its distance from said crossing and as to the time when said transmission of a next successive message from said approaching train is required, computing a minimum time for said equipment to be disposed in said second state when said link is first established upon receipt of a first of said messages from said approaching train, and updating said minimum time upon each interchange of messages from said equipment to said train and from said train back to said equipment.

2. The method according to claim 1 wherein said communications link establishing step is carried out by radio.

3. The method according to claim 1 further comprising the step of communicating first signals to the approaching train when it is at a location sufficiently far from the crossing to enable the train to stop when travelling at maximum speed, carrying out said communications link establishing step when said approaching train receives said first signals.

4. The method according to claim 3 wherein said first signals communicating step is carried out by transmitting said first signals from a trackside beacon at said location.

5. The method according to claim 4 wherein said first signals communicating step is carried out by transponding with said beacon when said train is at said location.

6. The method according to claim 5 wherein said first signals are transmitted from said beacon with information as to the identity of the crossing which distinguishes it from other crossings along the tracks, the direction from which the train is approaching the crossing, the identity of which track of multiple tracks on which the train is travelling, and the distance to the crossing.

7. The method according to claim 6 further comprising the step of coding said messages from said train to said equipment with said information.

8. The method according to claim 7 wherein said step of coding said messages from said approaching train to said equipment also includes coding said messages from said approaching train with the identity of said approaching train.

9. The method according to claim 8 further comprising the step of transmitting said messages from said equipment to said approaching train as acknowledgment messages each coded with the identity of the approaching train so that said acknowledgment messages are addressed exclusively to the approaching train.

10. The method according to claim 1 further comprising the step of detecting the successive occurrence of occupancy and unoccupancy of said crossing by a train, operating said equipment to its second state when said minimum time, as updated, expires, and operating said equipment back to its first state when said detecting step reveals the successive occurrence of unoccupancy of said crossing by a train.

11. The method according to claim 1 further comprising the step of performing vital, safety checks in said communications link at said train and at said crossing equipment, and stopping said train or operating said equipment to its second state when said vital checks indicate an error in said messages.

12. The method according to claim 1 further comprising the step of operating wayside signals to allow the approaching train to proceed past sad wayside signals toward the crossing when said communications link is established and to disallow the approaching train to proceed when said communications link has not been established.

13. The method according to claim 12 wherein said wayside signal operating step is carried out by transmitting radio messages addressed to said wayside signals from said crossing equipment when said link is established.

14. The method according to claim 1 further comprising the step of detecting when the approaching train reaches a minimum distance from the crossing to allow the crossing equipment to be operated to said second state immediately when the approaching train is detected at said minimum distance and said communications link has not been established.

15. The method according to claim 4 further comprising preventing the approaching train from reaching the crossing under conditions when signs further from the crossing than said beacons are not manually acknowledged within a predetermined time before said first signals from said beacon are detected by the approaching train.

16. Apparatus for controlling the operation of crossing protection equipment guarding a highway crossing for railroad tracks along which trains travel, said equipment having first and second states in which highway traffic across said tracks is allowed and disallowed respectively, said apparatus comprising means for establishing a communications link between a train approaching said crossing and the equipment, means for interchanging messages over said link from said approaching train to said equipment and from said equipment to said approaching train, respectively, as to the speed of said approaching train and its distance from said crossing and as to the time when said transmission of a next successive message from said approaching train is required, means for computing a minimum time for said equipment to be disposed in said second state when said link is first established upon receipt of a first of said messages from said approaching train, and means for updating said minimum time upon each interchange of messages from said equipment to said train and from said train back to said equipment.

17. The apparatus according to claim 16 further comprising radio means at said crossing and carried on said train for establishing said communications link.

18. The apparatus according to claim 16 further comprising means for communicating first signals to the approaching train when it is at a location sufficiently far from the crossing to enable the train to stop when travelling at maximum allowable speed, means for establishing said communications link when said approaching train receives said first signals.

19. The apparatus according to claim 18 further comprising a trackside beacon at said location, and said first signals communicating means comprises means for transmitting said first signals from said trackside beacon.

20. The apparatus according to claim 19 wherein said first signals communicating means comprises means for transmitting said first signals with information as to the identity of the crossing which distinguishes it from other crossings along the tracks, the direction from which the train is approaching the crossing, the identity of which track of multiple tracks on which the train is travelling, and the distance to the crossing.

21. The apparatus according to claim 20 wherein said establishing means comprises coding said messages from said train to said equipment with said information.

22. The apparatus according to claim 21 wherein said means for coding said messages from said approaching train to said equipment includes means for coding said messages from said approaching train with the identity of said approaching train.

23. The apparatus according to claim 22 wherein said establishing means comprises means for transmitting said messages from said equipment to said approaching train as acknowledgment messages each coded with the identity of the approaching train so that said acknowledgment messages are addressed exclusively to the approaching train.

24. The apparatus according to claim 16 further comprising means for detecting the successive occurrence of occupancy and unoccupancy of said crossing by a train, means for operating said equipment to its second state when said minimum time, as updated, expires, and means for operating said equipment back to its first state when said detecting step reveals the successive occurrence of unoccupancy of said crossing by a train.

25. The apparatus according to claim 16 further comprising means for performing vital, safety checks in said communications link establishing means at said train and at said crossing equipment, and means for stopping said train and operating said equipment to its second state when said vital checks indicate an error in said messages.

26. The apparatus according to claim 16 further comprising wayside signals spaced from said crossing, means for operating said wayside signals to allow the approaching train to proceed past said wayside signals toward the crossing when said communications link is established and to disallow the approaching train to proceed when said communications link has not been established.

27. The apparatus according to claim 26 wherein said wayside signal operating means comprises means for transmitting radio messages addressed to said wayside signals from said crossing equipment when said link is established.

28. The apparatus according to claim 16 further comprising means for detecting when the approaching train reaches a minimum distance from the crossing allowing minimum time for the highway crossing protection equipment to assume said second state and means for operating said crossing equipment to its second state when said train is detected at said minimum distance and said communications link has not been established.

29. The apparatus according to claim 19 further comprising pre-acknowledgement signs spaced beyond said beacon away from said said crossing, means for preventing the approaching train from reacting the crossing under conditions when said signs are not manually acknowledged within a predetermined time before said first signals from said beacon are detected by the approaching train.

* * * * *